US005098142A

United States Patent [19]

Fontenot

[11] Patent Number: 5,098,142

[45] Date of Patent: Nov. 26, 1991

[54] DOOR SECURITY LOCK

[76] Inventor: Albert M. Fontenot, 6355 Westheimer #300, Houston, Tex. 77057

[21] Appl. No.: 586,953

[22] Filed: Sep. 24, 1990

[51] Int. Cl.[5] ..... E05C 19/18

[52] U.S. Cl. ..... 292/292; 292/288

[58] Field of Search ..... 292/288, 302, 264, 341.15, 292/244, 295, 292, 296, 289

[56] References Cited

U.S. PATENT DOCUMENTS

| | | | |
|---|---|---|---|
| 10,511 | 2/1854 | Webb | 292/292 |
| 95,231 | 9/1869 | Jones | 292/288 |
| 299,742 | 6/1884 | Conner | 292/291 |
| 359,815 | 3/1887 | Sargent | 292/291 |
| 366,843 | 7/1887 | Jones | 292/288 |
| 405,581 | 6/1889 | Marshall et al. | 292/292 |
| 518,253 | 4/1894 | Kimball | 292/288 |
| 583,363 | 5/1897 | Dunwald | 292/292 |
| 692,083 | 1/1902 | Spear | 292/292 |
| 761,955 | 6/1904 | Glock et al. | 292/292 |
| 1,020,721 | 3/1912 | Snyder | 292/148 |
| 1,267,647 | 5/1918 | Everett | 292/295 |
| 1,839,506 | 1/1932 | Shepherd | 292/288 |
| 1,869,689 | 8/1932 | Holland | 292/288 |
| 1,971,440 | 8/1934 | Aubertin | 292/289 X |
| 2,396,982 | 3/1946 | Bousquet | 292/289 |
| 3,206,793 | 9/1965 | Silverberg | 292/288 X |
| 3,313,566 | 4/1967 | Sipes | 292/292 |
| 3,316,005 | 4/1967 | Oesler | 292/296 |
| 3,421,787 | 1/1969 | Hoffman et al. | 292/289 |
| 3,761,118 | 9/1973 | Westcott | 292/292 |
| 3,788,107 | 1/1974 | Lippman | 292/264 X |
| 3,809,418 | 5/1974 | Canfield | 292/264 |
| 3,914,965 | 10/1975 | Paxton | 292/288 X |
| 3,951,443 | 4/1976 | Barnaby | 292/302 X |
| 4,015,868 | 4/1977 | Buttler | 292/302 |
| 4,082,333 | 4/1978 | Segal | 292/264 |
| 4,155,578 | 5/1979 | Rolland | 292/292 |
| 4,208,841 | 6/1980 | Starks | 292/343 X |
| 4,254,976 | 3/1981 | Shoberg | 292/292 |
| 4,268,074 | 5/1981 | Alexander | 292/288 X |
| 4,281,865 | 8/1981 | Nicholson | 292/258 |
| 4,326,394 | 4/1982 | Stein | 292/292 |
| 4,334,705 | 6/1982 | Rumph | 292/288 |
| 4,386,797 | 6/1983 | Duran, Sr. | 292/292 |
| 4,439,758 | 3/1984 | Cantley | 292/288 X |
| 4,466,261 | 8/1984 | Zimmer | 70/229 |
| 4,471,981 | 9/1984 | Wright | 292/292 |
| 4,575,140 | 3/1986 | Dargis | 292/289 X |
| 4,623,180 | 11/1986 | Zimmerly | 292/264 |
| 4,627,651 | 12/1986 | Grimbly | 292/302 X |
| 4,844,519 | 7/1989 | Dagon | 292/302 X |
| 4,958,868 | 9/1990 | Watrous, Jr. | 292/291 |

*Primary Examiner*—Richard E. Moore

*Attorney, Agent, or Firm*—Browning, Bushman, Anderson & Brookhart

[57] ABSTRACT

A door locking device for preventing an opening of a hinged door. The locking device of the present invention includes a door jamb restraint independent of the conventional striker plate and secured to a door facing surface of the door jamb. In one embodiment, a main plate is provided independent of the door handle for engagement with the door jamb restraint. The main plate includes a central plate portion in engagement with the door jamb restraint, a first wing fixed on one side of the central plate portion for engagement with the interior room wall, and a second wing portion fixed on the opposing side of the central plate portion for engagement with the door, thereby preventing rotation of the main plate with respect to the door jamb restraint and thus preventing opening of the door. The device of the present invention is relatively inexpensive and does not operate in conjunction with the door handle or a conventional door jamb striker plate for increased versatility and ease of installation.

27 Claims, 3 Drawing Sheets

DOOR SECURITY LOCK

BACKGROUND OF THE INVENTION

1. Field of the Invention

The present invention relates to methods and apparatus for locking a conventional personnel access door for security purposes and, more particularly, relates to improved methods and apparatus for securing a door without relying upon the hardware of a conventional door latch.

2. Description of the Background

Various types of door security devices, safety latches, door locks, and door restraint mechanisms have been devised to prevent the unauthorized intrusion of persons. Unfortunately many such devices can be picked, pried apart, or otherwise defeated by intruders, and do not offer the desired assurance of security. Other door security devices are difficult to manufacture, install or use. Many such devices include complicated and expensive parts, and accordingly are not regularly used by personnel. Finally many door security devices are functionally dependent upon the design of the door knob, and/or operate in conjunction with the striker plate in the door jamb adapted for receiving the door latch. Accordingly, such devices cannot be universally used on all doors, and the location of the security device is necessarily determined by the location of the conventional door latching device.

U.S. Pat. No. 4,281,865 discloses an inner door security device which is rather complicated in its design and use, and relies upon the door knob as a functional component of the security device. U.S. Pat. Nos. 366,843 4,155,578; 4,334,705 and 4,386,797 are also directed to door locking devices, although each of these locking devices again relies upon the door knob to perform its intended function, and therefore must be located at the position of the door knob. The spacing from the door knob to the edge of the door may vary, and some door knobs are positioned near the middle of the door for aesthetic reasons. Accordingly the devices disclosed in these patents cannot be universally used for all doors. U.S. Pat. No. 3,809,418 is directed to a chain-type door locking device which functionally relies upon both the door knob and the door jamb striker plate. U.S. Pat. No. 2,396,982 discloses an alternate design for a door lock, which again relies upon a modified striker plate to perform its intended function.

U.S. Pat. No. 4,254,976 discloses a complicated and expensive door lock mechanism, which also works in conjunction with a door knob and striker plate. A significantly simpler version of a door lock is disclosed in U.S. Pat. No. 4,575,140, although this door lock again relies upon a new striker plate and a main plate which fits over the door handle. U.S. Pat. No. 3,316,005 also discloses a modified striker plate with a wing which extends inwardly from the door jamb. The device of the '005 patent includes a locking plate with a slot which slides over the striker plate wing, and a lower bar pivotable with respect to the locking plate may be positioned to prevent removal of the locking plate. U.S. Pat. No. 3,421,787 discloses a keeper plate secured to a door jamb, and a locking plate which also slides over and may be fitted within a selected groove in the keeper plate. A sliding bolt plate prevents removal of the locking plate with respect to the keeper plate. U.S. Pat. No. 4,015,868 discloses a door lock with interlocking hinge plates. In addition to being unsightly, the hinge plate concept as disclosed in this patent requires that the door itself be damaged by securing one of the plates to the door.

The disadvantages of the prior art are overcome by the present invention, and an improved door locking device and method are hereinafter disclosed which may be used to reliably prevent unauthorized intrusion. In preferred embodiments, the door locking device of the present invention need not damage or mar the door. Most importantly, the device of the present invention may be positioned at any desired elevation, and need not operate in conjunction with the door handle or conventional door jamb striker plate. Various embodiments of the present invention may employ a universal door jamb restraint, thereby reducing manufacturing and inventory costs, while increasing the versatility of the door lock to the user.

SUMMARY OF THE INVENTION

The door lock of the present invention includes several embodiments subsequently described in detail. The device may take the form a door lock which prohibits any significant movement or opening of a door, or a door restraint device which allows only partial opening of the door for communication and/or limited access of envelopes, documents, etc. In each of these embodiments, the device is preferably manufactured from high strength steel components, and is ruggedly designed to withstand high forces by intruders. The device may be positioned at any desired elevation since it does not functionally operate in conjunction with a door handle or a conventional door jamb striker plate. The device may thus be installed and used on almost any door, is highly versatile due to the use of a universal door restraint member with different embodiments, and may optionally be positioned out of the reach of children.

In one embodiment, the door lock comprises a door jamb restraint comprising a plate portion and a cylindrical portion. The plate portion may be secured to the door jamb by conventional screws, with the cylindrical portion extending into the room and preferably slightly away from the door. A main plate includes an elongate vertical slot and a pair of wings which project inwardly to engage the wall adjacent the door jamb and the door, respectively. The main plate may be slid over the door jamb restraint, with the slot positioned between the cylindrical portion and a pair of stops. The combination of the cylindrical portion and the stops increases the structural integrity of the door lock, such that the door is prevented from opening both by the engagement of the wings with the door and interior wall, and by the binding forces acting between the door jamb restraint and the main plate.

In another embodiment, the door lock includes a door jamb restraint as previously described, and a main plate substantially similar to that described above, except that a pin shaped member is fixed to the main plate, and fits within the passageway in the cylindrical portion of the door jamb restraint. The pin may project downwardly from the cylindrical portion, and a conventional cylindrical lock may be attached to the lower end of the pin to prevent unauthorized removal of the main plate and thus opening of the door. Still further embodiments of the present invention are described in detail below.

It is an object of the present invention to provide a highly reliable yet relatively inexpensive door lock which may be positioned at any desired elevation.

It is a further object of this invention to provide a door lock which may be installed on most existing doors, and does not operate in conjunction with the door handle or a conventional door jamb striker plate.

So a further object of the present invention is a relatively simple and thus inexpensive door lock device which may be easily and quickly installed and reliably used by relatively inexperienced personnel.

It is a feature of the present invention that no component of the door lock need be fixed to or carried by the door, and that the device does not damage or mar the door during use or installation.

Yet another feature of this invention is that the door lock device may be easily removed from one door and installed on another door.

Still a further feature of the invention is that the door lock includes a door jamb restraint which may be employed by various door jamb plates or other securing devices to reduce manufacturing costs and increase the versatility of the lock.

It is an advantage of this invention that the device may be easily installed and used in homes, offices, and apartments.

Still another advantage of the present invention is that multiple vertically-spaced door lock devices may be used for increased security.

These and further objects, features, and advantages of the present invention will become apparent from the following detailed description, wherein references made to the figures in the accompanying drawings.

BRIEF DESCRIPTIONS OF THE DRAWINGS

DETAILED DESCRIPTION OF PREFERRED EMBODIMENTS

Figure 1:
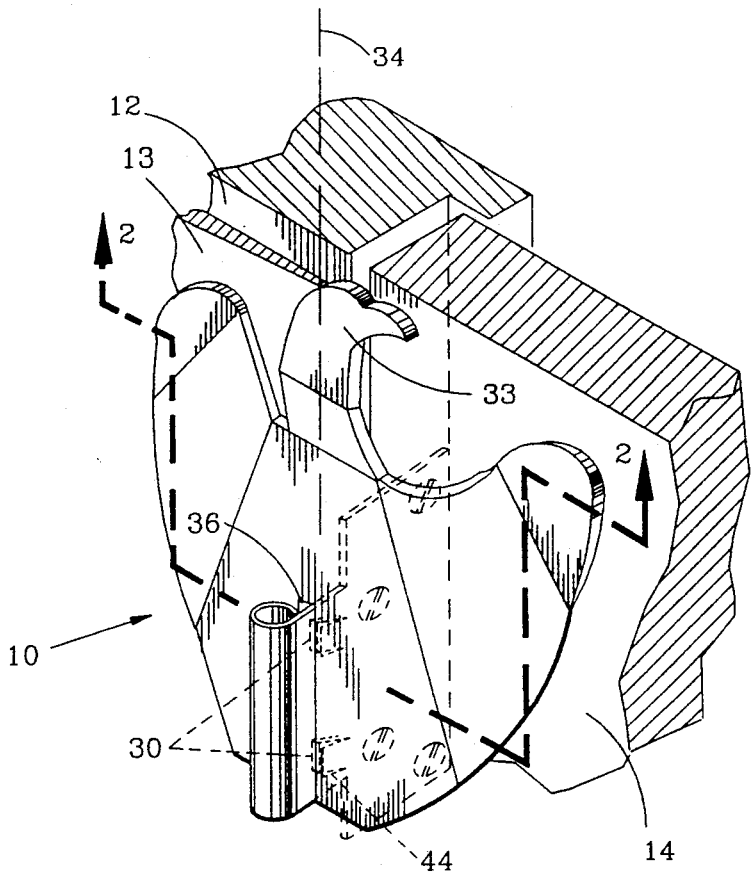
FIG. 1 is a pictorial view of one embodiment of a door lock according to the present invention, illustrating its installed position relative to the edge of the door and the door jamb.

FIG. 1 illustrates an entry door lock according to the present invention. Lock 10 is supported entirely by the conventional door jamb 12, and prevents intrusion by prohibiting the door 14 from swinging inward. Since the lock 10 is not fixed or secured to the door, the door itself is not damaged or marred by the installation or use of the lock 10. Also, the lock does not utilize or rely upon the door handle or conventional door striker plate, and thus may be positioned vertically at any selected elevation from the floor. This is a significant feature of the invention, and enables the door lock to be installed at an elevation such that children cannot disengage the lock.

Figure 2:
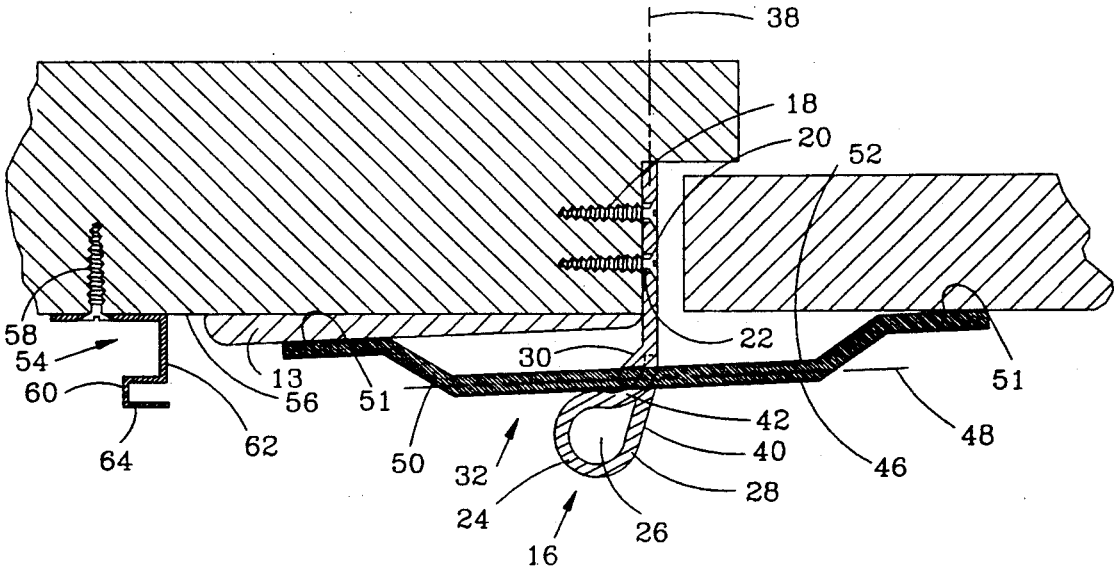
FIG. 2 is a top cross-sectional view of the door lock shown in FIG. 1, and also illustrating a hanger for the main plate.

The door jamb restraint 16 is a monolithic piece stamped and rolled to the desired configuration from thick metal plate. Referring to FIGS. 1 and 2, restraint 16 includes a planar plate portion 20 which is securely fastened to the door hinge facing surface of the door jamb by conventional wood screws 18 each passing through one of the holes 22 in the plate portion 20. Cylindrical portion 24 extends slightly into the room, and has a through passage 26 discussed subsequently. A pair of stops 30 extend from the plate 20 in the direction opposite the door. The main plate 32 is also fabricated from ⅛" thick metal plate, and preferably is symmetrical about axis 38. The main plate 32 includes an elongate vertical slot 36 for fitting onto the restraint 16 between the stops 30 and cylindrical portion 24.

FIG. 2 is a horizontal cross-sectional view through the restraint 16 along the upper stop 30. Preferably the plate portion 40 is bent slightly away from the door at an angle of from 6° to 14°, and preferably about 10°, with respect to a central plane 38 for the restraint 16. As shown in FIG. 2, the bend of this bent portion 40 commences adjacent the stops 30, and extends to the cylindrical portion 24. The end of cylindrical portion 24 includes a pair of tabs 42 which fit within a slot portion 44 to prevent cylindrical portion 24 from being forced open. FIG. 2 depicts a horizontal cross-sectional view of the main plate 32 taken along line 2—2 in FIG. 1. The main plate includes a central body portion 46 which lies within and defines a vertical central plane 48, and a pair of identical "wings" 50 each extending outward from the main body portion 46. Each wing 50 is bent for engagement with the door or the door jamb, as shown in FIG. 1. The spacing between the planar engaging surface 51 of each wing and the interior surface 52 of portion 46 is approximately ⅛", and this spacing ensures that a tight fit will occur between the main plate and both the door and door jamb, thereby preventing the slight opening of the door by an intruder. FIG. 2 depicts that an interior door jamb molding 13 may tilt the main plate 32 slightly from a plane perpendicular to central plane 38, but this does not adversely affect the versatility of the device 10. As shown in FIG. 1, the top of the main plate 32 includes a decorative handle portion 33, which is illustrated in the shape of an eagle head, with handle portion 33 extending inward from the main body 46 in a direction opposite the wings to provide a convenient mechanism for grasping and manipulating the main plate.

FIG. 2 also depicts a main plate holder 54 which may be mounted on wall 56 adjacent the door jamb 12 by a pair of light-weight vertically spaced screws 58. The slot 36 fits within portion 60, while portion 62 provides sufficient spacing from the wall to ensure that the main plate does not contact and mar the wall 56. The slot 36 is preferably only slightly wider than the width of the planar plate portion 20 to minimize lateral movement of the main plate with respect to the restraint 16. Lip portion 64 ensures that the main plate will be retained on holder 54 until the user lifts the main plate vertically off the holder. The door jamb restraint 16 is preferably symmetrical about a central horizontal plane, and the main plate 32 symmetrical about a central vertical plane, so that each component may be used with either a left-hand door or a right-hand door.

Figure 3:
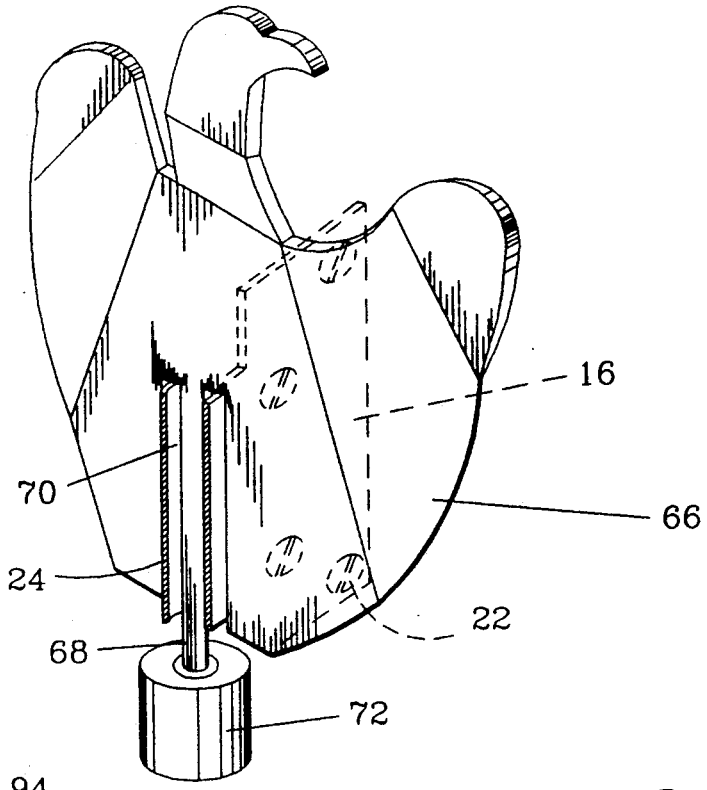
FIG. 3 is a pictorial view, partially in cross-section, of another embodiment of a door lock according to the present invention.

FIG. 3 depicts another lock according to the present invention, which includes a door jamb restraint 16 as previously disclosed and a modified main plate 66. A feature of the present invention is that the restraint 16, as well as the holder 54, may be used in various embodiments described herein, thereby reducing manufacturing cost and increasing the versatility to the user. The main plate 66 includes a handle portion and wings identical to those previously discussed, except that the bend of the wings toward the door and the door jamb may be increased slightly since the main body of the plate 66 is spaced slightly further away from the wall than the main plate previously described. Instead of a narrow slot, the main plate 66 includes a pin 68 positioned within a substantially wider slot 70. The pin 68 may thus be easily stamped from the main plate by cutting a pin between a pair of slots, or a single wide slot may be formed in the plate and the pin 68 welded or otherwise fixed to the main plate. The pin 68 slides within the passageway 26 in the cylindrical portion 24, and extends downward from the cylindrical portion so that a conventional cylinder lock 72 may be used to prevent the main plate from being lifted off the hinge. Lock 72 may be of the conventional type marketed by various manufacturers, and may be either a key or combination lock.

If a cylinder lock 72 is not utilized, the pin 68 need not extend past the hinge, and in this case a substantially shorter pin may be used with the main plate 66, such that the lower end of the pin 68 terminates within or slightly below the lower end of the passageway 26. An advantage at the embodiment depicted in FIG. 3 is that the main plate 66 cannot be lifted off the restraint 16, and thus the door cannot be opened, unless the cylinder lock 72 is first removed by an authorized individual possessing the lock key or combination. In either case, a main plate 66 with either a short pin or a long pin may be retained within the keeper 54 shown in FIG. 2 by fitting a slot on either side of the pin 68 within portion 60 of the keeper, as disclosed above.

For each of the embodiments depicted in FIGS. 1–3, the restraint 16 as described is installed in position on the door hinge facing surface of the door jamb at any desired elevation. The main plate is slid into position so that the wings engage or almost engage both the door and the internal wall surface adjacent the door jamb. If the embodiment as shown in FIG. 3 is used, the cylinder lock is then installed on the lowermost end of the pin extending from the cylindrical portion. To deactivate the lock for entry of a guest, visitor, etc., the cylinder lock (if used) is removed, and the main plate lifted vertically off the restraint 16. If desired, the main plate may be stored on the holder 54 during periods when the lock is not in its active position against the door. The surfaces of the main plate as depicted in FIGS. 1–3 which engage the door or the interior wall of the room may be lined or coated with a suitable material, such as felt, to further reduce marring of the door or wall during normal use.

Figure 4:
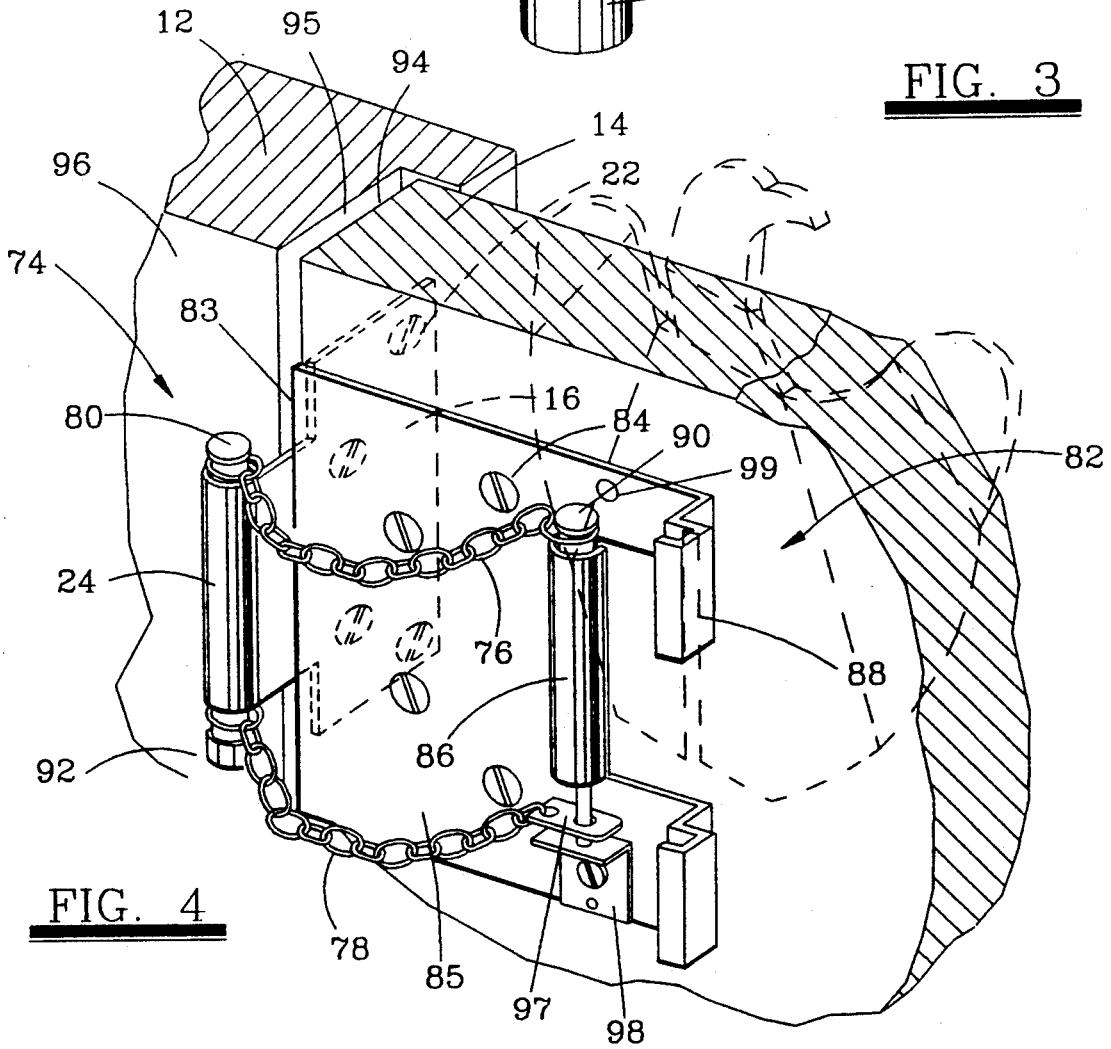
FIG. 4 is a pictorial view of one embodiment of a door restrain device according to the present invention.

FIG. 4 depicts another embodiment of the invention. The door restraint device 74 is distinguishable from the door lock devices previously described in that the length of chains 76 and 78 determines the extent the door can be partially opened. Again, the door 74 includes a door jamb restraint 16 as previously described, which is secured to the door jamb by screws 22. The pin 80 is shown in the passageway 26 of the cylindrical portion 24, with the pin extending downward through the cylindrical portion so that a conventional lock nut 92 may be secured to the pin 80 to prevent its unauthorized removal. A plate member 82 is secured to the inward face of the door 14 with its edge 83 aligned with the edge of the door 14 as shown, and a plurality of screws 84 may fix the plate to the door. A cylindrical portion 86 extends from the plate portion 85 of member 82. Bracket 88 is fixed to plate portion 85 and serves as a support for the main plate 32 when not in use (the main plate 32 is shown in dashed lines in FIG. 4 supported on the bracket 88). Both the plates 16 and 82 are symmetrical, so that either plate can be used on a left-hand or right-hand opening door.

A second pin 90 is fitted within the passageway of the cylinder portion 86 fixed to the door 14. Each end of chain 76 is fixedly secured to the upper ends of pins 80 and 90, respectively. An end of the lower chain 78 is permanently fixed to the nut 92 or may be retained on the pin 80 by the nut 92, as shown. The opposing end of the chain 78 is preferably provided with a small plate or tab 97 fixed thereto, and having a passageway therein for receiving the lower end of the pin 90. A keeper bracket 98 is secured to plate portion 85 by a screw 84, and also receives the lower end of pin 90, thereby securing the end of chain 78 to the cylindrical portion 86. Since the entire plate 82 is reversible, a hole 99 is provided in the plate portion 85 to receive a screw 84 and thus secure the keeper bracket 98 in place if the entirety of 82 is inverted.

Restraint 74 as depicted in FIG. 4 thus allows the door 14 to open slightly, but its openings is restricted by the length of chains 76, 78. The double chain concept of the device according to the present invention increases security, since a single chain is typically the member in prior art devices which fails. To deactivate the restraint, the user lifts the pin 90 from the cylindrical portion 84, so that each of the chains 76 and 78 are free and the door may be easily opened.

Other embodiments will be suggested from the embodiment depicted in FIG. 4 and discussed above. In particular, the main plate as depicted in FIG. 1 may also be used in conjunction with the plate 82 and the chains 76 and 78. In this case, the main plate 16 may be positioned in place on 16 so that its slot 36 fits between the cylindrical portion 24 and the stops 30. The only difference from the embodiment depicted on FIG. 1, at this stage, is that the wing surface 51 contacts the plate 82 rather than the internal surface of the door to prevent opening of the door. If the user desires limited access, e.g., the user believes he or she may recognize the caller or wishes to allow the caller to pass a letter to the user, the main plate 16 may be removed and placed on 88 as shown in FIG. 4, and the door then partially opened for limited access.

Figure 5:
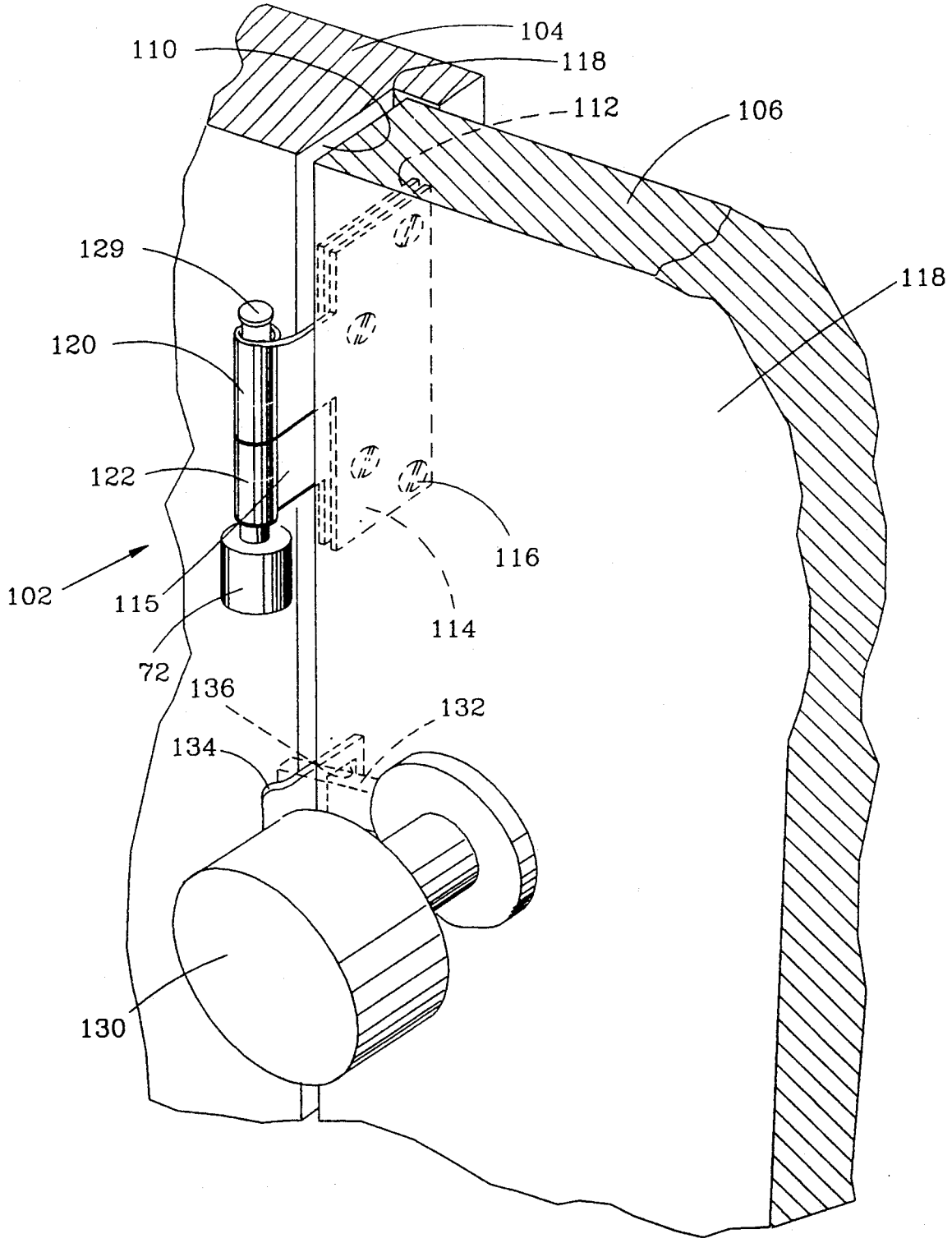
FIG. 5 is a pictorial view of a further embodiment of a door lock according to the present invention.

FIG. 5 depicts yet another embodiment of a door lock device 102 according to the present invention. The device 102 may be used to lock together adjacent free ends of two hinged doors, such as French doors 104, 106, each having a free end as depicted in FIG. 5. Member 112 may be secured by screws to the end surface 110 of door 104, while a similar member 114 is secured by screws 116 to the opposing face 118 of door 106. Member 112 may be similar to member 16 previously described, except that the entire cylinder portion 24 is replaced with short cylindrical portions 122, and the stops 30 need not be included. Member 114 supports a similar short cylindrical portion 120, so that portions 122 and 120 when assembled as shown in FIG. 5 form a substantially continuous cylinder to receive pin 192. The cylindrical portion 120 is thus secured to plate 114 by curved plate portion 115, so that the passageways in portions 120 and 122 are aligned to receive pin 129 when the doors 104 and 106 are closed. A cylinder lock 72 may optionally be provided at the end of the pin 129, and if desired a chain (not shown) may be attached to the one of the doors and the pin 129 to keep the pin adjacent the plates when not positioned within the cylinder formed by portions 122 and 120 of members 112 and 114, respectively.

Various further embodiments will be suggested from the specific embodiment shown in FIG. 5. The cylinder lock 72 need not be utilized, so that the pin 129 can be simply lifted out of the interlocking cylindrical members 120, 122 to allow the doors to open. Also door 106 may be hinged and door 104 replaced with a solid wall, such that 112 is secured to the door jamb rather than a door. For each of the embodiments described herein, the locking or latching device does not functionally operate in conjunction with the conventional door knob 130 having a conventional latch or lock 132, with the latch 132 acting in conjunction with a striker plate 134 affixed to the door jamb (or second door) and having a cutout 136 for receiving the latch 132. Also, the design of members 112, 114 may be changed so that the cylindrical portion extends vertically downward from the plate portion of one member, while the cylindrical portion of the other member extended vertically upward from its plate portion. In this case, the members would still be fixed to the doors (or door and door jamb), although the plates may be vertically spaced so that when the door is closed the plates are vertically spaced from each other (thereby conserving space between the doors (or the door and the jamb), although the cylindrical portions are still aligned to receive the pin 129.

The components of the door lock as described herein may be fabricated from relatively inexpensive steel or other suitable material having the necessary strength and sized accordingly. The components of the door locking device which are subject to high forces during an attemted unauthorized entry are preferably manufactured from rugged material, so that the door locking device can withstand such high forces. Components may be heat treated and hardened in a conventional manner to increase structural integrity. Relatively long screws may be used to secure members to the door, or the door jamb, thereby further enhancing the structural integrity of the lock. It should be understood that an installed door restraint member 16 as shown in FIGS. 1–4 need not be removed in order that the different main plates as shown in FIGS. 1–3 can be utilized. Also, the main plate may be eliminated and the mechanism 82 as shown in FIG. 4 installed with an existing member restraint 16, or the main plate as shown in FIGS. 1 and 2 used in conjunction with mechanism 82. Multiple door lock devices may be installed at different elections, since the device does not depend on the fixed location of a door handle or conventional striker plate.

Various other changes and modifications to the present invention should be apparent form the foregoing description. Such changes are within the scope of the present invention, which is determined by the following claims.

What is claimed is:

1. A door locking device for preventing the opening of a hinged door having a door handle and a door latch, the door being closable against a door jamb adjoining an interior room wall, the door jamb having an opening for receiving the latch and a striker plate adjoining the opening, the door locking device comprising:

a door jamb restraint independent of the striker plate;

a securing member structurally independent of the door jamb restraint for fixing the door jamb restraint to a door facing surface of the door jamb and spaced from the striker plate;

the door jamb restraint including a planar plate portion in engagement with the door jamb and a cylindrical portion affixed to the planar plate portion and extending therefrom inwardly of the interior room wall and away from the hinged door;

a main plate independent of the door handle for engagement with the door jamb restraint to prevent opening of the door; and the main plate including a central plate portion for engagement with the cylindrical portion of the door jamb restraint and spaced inwardly of the interior room wall and the door, the central plate portion including a downwardly extending slot for receiving the door jamb restraint to position the main plate between the door and the cylindrical portion, the cylindrical portion of the door jamb restraint having cross-sectional width greater than the slot for preventing movement of the main plate away from the interior wall and the door, a first side portion fixed on one side of the central plate portion for engagement with the interior room wall, and a second side portion fixed on the opposing side of the central plate portion for engagement with the door.

2. The door locking device as defined in claim 1, wherein the slot in the central plate portion of the main plate has a width slightly greater than the thickness of the planar plate portion of the door jamb restraint to minimize lateral movement of the main plate with respect to the door jamb restraint.

3. The door locking device as defined in claim 1, further comprising:

the cylindrical portion of the door jamb restraint having a through passageway therein;

a substantially vertical pin fixed to the central plate portion of the main plate for fitting within the passageway of the cylindrical portion of the door jamb restraint.

4. The door locking device as defined in claim 3, further comprising:

the pin having a lower end extending downwardly from the cylindrical portion of the door jamb restraint; and the locking device for securing to the lower end of the pin and thereby preventing removal of the main plate portion from the door jamb restraint.

5. The door locking device as defined in claim 1, wherein the door jamb restraint is symmetrical about a horizontal plane, such that the door jamb restraint may be secured to a door jamb for either a left-hand or a right-hand door.

6. The door locking device as defined in claim 5, further comprising:

the main plate is symmetrical about a vertical plane, such that an installed main plate and door jamb restraint prevent opening of either a left-hand or right-hand door.

7. The door locking device as defined in claim 1, and the main plate further comprises:

a handle extending inwardly from the central plate portion of the main plate for manual manipulation of the main plate.

8. The door locking device as defined in claim 1, further comprising:

one or more tabs extending from an end of the cylindrical portion of the door jamb restraint; and the planar plate portion includes one or more recesses each for receiving a corresponding tab and fixedly interconnecting the tab to the planar plate portion to minimize spreading of the cylindrical portion of the door jamb restraint.

9. The door locking device as defined in claim 1, further comprising:

a main plate holder for securing to the interior room wall to support the main plate when the main plate is not positioned on the door jamb restraint, the main plate holder being independent of the door jamb restraint and having a vertical plate portion for receiving the slot in the main plate and a lip portion for preventing the main plate from being moved horizontally off the main plate holder.

10. A door locking device for preventing the opening of a hinged door having a door handle and a door latch, the door being closable against a door jamb adjoining a wall and including a striker plate, the door locking device comprising:

a door jamb restraint securable to a door facing surface of the door jamb;

a securing member structurally independent of the door jamb restraint for fixing the door jamb restraint to the door facing surface of the door jamb and spaced from the striker plate;

the door jamb restraint including a planar plate portion for engagement with the door jamb and a stop portion affixed to the planar plate portion and extending therefrom inwardly of the interior room wall and away from the hinged door the stop portion having a substantially vertical through passage therein;

a main plate independent of the door handle for engagement with the door jamb restraint to prevent opening of the door;

one or more stops on the planar plate portion of the door jamb restraint for engagement with the main plate to prevent rotation of the main plate in at least one direction by engagement with both the stop portion and the one or more stops; and the main plate including a central plate portion having a substantially vertical slot for receiving the planar plate portion of the door jamb restraint and spaced inwardly of the wall and the door, a first wing fixed on one side of the central plate portion for engagement with the interior room wall, and a second wing fixed on the opposing side of the central plate portion for engagement with the door, such that the main plate is prevented from moving past the stop portion to prevent opening of the door.

11. The door locking device as defined in claim 10, wherein the slot in the central plate portion of the main plate has a width slightly greater than the thickness of the planar plate portion of the door jamb restraint to minimize lateral movement of the main plate with respect to the door jamb restraint.

12. The door locking device as defined in claim 10, wherein each of the first and second wings are spaced opposite the stop portion with respect to the central plate portion when the slot in the central plate portion is received within the planar plate portion of the door jamb restraint.

13. The door locking device as defined in claim 10, wherein the main plate further comprises:

a handle extending inwardly from the central plate portion of the main plate for manual manipulation of the main plate.

14. The door locking device as defined in claim 10, comprising:

a main plate holder for securing to the interior room wall to support the main plate when the main plate is not positioned on the door jamb, the main plate holder being independent of the door jamb restraint and having a vertical plate portion for receiving the slot in the main plate and a lip portion for preventing the main plate from being moved horizontally off the main plate holder.

15. A door locking device for preventing the opening of a hinged door closable against a door jamb adjoining a wall, the door locking device comprising:

a door jamb restraint securable to a door facing surface of the door jamb;

the door jamb restraint including a planar plate portion for engagement with the door jamb and a cylindrical portion affixed to the planar plate portion and extending therefrom inwardly of the interior room wall.

the cylindrical portion of the door jamb restraint having a through passage therein and a terminal end portion in secured engagement with the planar plate portion;

a main plate independent of the door handle for engagement with the door jamb restraint to prevent opening of the door; and the main plate including a central plate portion for engagement with the cylindrical portion of the door jamb restraint and spaced inwardly of the wall and the door, a first wing fixed on one side of the central plate portion for engagement with the interior room wall, and a second wing fixed on the opposing side of the central plate portion for engagement with the door.

16. The door locking device as defined in claim 15, further comprising:

one or more stops on the planar plate portion of the door jamb restraint for engagement with the central plate portion of the main plate to prevent the main plate from substantial rotation in at least one direction by engagement with both the cylindrical portion and the one or more stops.

17. The door locking device as defined in claim 16, further comprising:

the central plate portion of the main plate including a substantially vertical slot, such that the slot in the central plate portion receives the planar plate portion of the door jamb restraint.

18. The door locking device as defined in claim 15, the main plate further comprising:

a handle extending outwardly from the central plate portion of the main plate for manual manipulation of the main plate.

19. A door locking device as defined in claim 1, wherein the cylindrical portion of the door jamb restraint has a terminal end portion in secured engagement with the planar plate portion.

20. A door locking device as defined in claim 1, wherein the cylindrical portion of the door jamb restraint has a substantially vertical through passage therein.

21. The door locking device as defined in claim 1, further comprising:

one or more stops on the planar plate portion of the door jamb restraint for engagement with the central plate portion of the main plate to prevent the main plate from substantial rotation in at least one direction by engagement of the main plate with both the cylindrical portion and the one or more stops.

22. The door locking device as defined in claim 1, wherein each of the first and second side portions of the main plate are bent toward the door and the interior room wall, respectively, with respect to the central plate portion.

23. The door locking device as defined in claim 10, wherein the stop portion of the door jamb restraint has a terminal end portion in secured engagement with the planar plate portion.

24. The door locking device as defined in claim 10, wherein each of the first and second wings are bent toward the door and interior room wall, respectively, with respect to the central plate portion.

25. The door locking device as defined in claim 15, further comprising:

the central portion of the main plate having a substantially vertical slot therein, such that the slot in the central portion of the main plate receives the planar plate portion of the door jamb restraint, and the cylindrical portion prevents the main plate from moving away from the wall to prevent opening of the door.

26. The door locking device as defined in claim 15, further comprising:

the central portion of the main plate including a pin for fitting within the passage of the cylindrical portion to prevent opening of the door.

27. The door locking device as defined in claim 15, wherein at least one of the first and second wings is bent inwardly with respect to the central plate portion.

* * * * *

UNITED STATES PATENT AND TRADEMARK OFFICE
CERTIFICATE OF CORRECTION

PATENT NO. : 5,098,142

DATED : March 24, 1992

INVENTOR(S) : Albert M. Fontenot

It is certified that error appears in the above-identified patent and that said Letters Patent is hereby corrected as shown below:

On the cover page, item number 45, Date of Patent:, delete "November 26, 1991" and insert therefor --March 24, 1992--.

In Column 9, line 26 (Claim 10, line 16), insert a "," after "hinged door".

In Column 10, line 16 (Claim 15, line 10), change "." to --;--.

Signed and Sealed this

Twentieth Day of July, 1993

*Attest:*

Michael K. Kirk

MICHAEL K. KIRK

*Attesting Officer*

*Acting Commissioner of Patents and Trademarks*